US008967393B2

(12) United States Patent
Bryson et al.

(10) Patent No.: US 8,967,393 B2
(45) Date of Patent: Mar. 3, 2015

(54) DISPLAY TRAY ASSEMBLY

(75) Inventors: M. Scott Bryson, Brookfield, WI (US); Terry Berglund, Hales Corners, WI (US); Dowie Soetenga, Waukesha, WI (US)

(73) Assignee: Process Retail Group, Inc., New Berlin, WI (US)

( * ) Notice: Subject to any disclaimer, the term of this patent is extended or adjusted under 35 U.S.C. 154(b) by 194 days.

(21) Appl. No.: 13/441,147

(22) Filed: Apr. 6, 2012

(65) Prior Publication Data

US 2012/0255922 A1 Oct. 11, 2012

Related U.S. Application Data

(60) Provisional application No. 61/472,458, filed on Apr. 6, 2011.

(51) Int. Cl.
*A47F 1/04* (2006.01)
*A47F 1/12* (2006.01)

(52) U.S. Cl.
CPC ..... *A47F 1/126* (2013.01); *F25D 2325/021* (2013.01)
USPC ..... 211/59.3; 211/184

(58) Field of Classification Search
USPC ..... 211/59.2, 59.3, 59.4, 184; 108/102, 108/137, 152
See application file for complete search history.

(56) References Cited

U.S. PATENT DOCUMENTS 905,737 A * 12/1908 McCombe ..... 108/137
1,257,843 A * 2/1918 Gonyea ..... 108/93
2,623,641 A 12/1952 Shield
3,061,969 A * 11/1962 Lunday ..... 248/448
3,447,491 A * 6/1969 Noren ..... 108/64
3,511,192 A * 5/1970 Noren ..... 108/64
4,830,201 A 5/1989 Breslow
4,901,869 A 2/1990 Hawkinson et al.
5,022,535 A 6/1991 Spamer
5,199,584 A * 4/1993 Fowler et al. ..... 211/184
5,255,802 A 10/1993 Krinke et al.
5,450,968 A 9/1995 Bustos
5,553,824 A * 9/1996 Dutra, Jr. ..... 248/346.07
5,740,926 A 4/1998 Mulloy
6,227,385 B1 5/2001 Nickerson
6,276,538 B1 8/2001 Battaglia et al.
6,311,852 B1 11/2001 Ireland
6,401,942 B1 6/2002 Eckert
6,409,028 B2 6/2002 Nickerson
6,513,667 B2 2/2003 Battaglia et al.
6,533,131 B2 3/2003 Bada
6,886,699 B2 5/2005 Johnson et al.
7,028,852 B2 4/2006 Johnson et al.
7,124,898 B2 10/2006 Richter et al.

(Continued)

*Primary Examiner* — Korie H Chan

(74) *Attorney, Agent, or Firm* — Andrus Intellectual Property Law, LLP

(57) ABSTRACT

The system of the present application includes a display tray assembly having base and center tray sections that are configured to form a gap that receives a side tray section on either side. The side tray sections are configured such that they may move laterally with respect to the base and center tray section in order to adjust the width of the entire display tray assembly to accommodate any size product in a retail environment. In lieu of side tray sections, the display tray assembly may include union tray sections that may engage two separate base and center tray section assemblies in order to create a continuous display tray assembly with adjustable widths.

13 Claims, 16 Drawing Sheets

(56) References Cited

U.S. PATENT DOCUMENTS

| | | | | |
|---|---|---|---|---|
| 8,016,139 | B2 * | 9/2011 | Hanners et al. | 211/184 |
| 8,235,226 | B2 * | 8/2012 | Crawbuck et al. | 211/59.3 |
| 2003/0085187 | A1 * | 5/2003 | Johnson et al. | 211/59.3 |
| 2003/0132178 | A1 * | 7/2003 | Jay et al. | 211/59.2 |
| 2010/0032391 | A1 | 2/2010 | Schneider et al. | |

* cited by examiner

DISPLAY TRAY ASSEMBLY

CROSS REFERENCE TO RELATED APPLICATION

This application is claims priority to U.S. Provisional Application No. 61/472,458, filed Apr. 6, 2011, the content of which is incorporated herein by reference in its entirety.

FIELD

The present application is directed to a display tray assembly. More specifically, the present application is directed to a freezer tray assembly for use in the display of products in a retail environment.

BACKGROUND

Current shelving systems, specifically freezer shelving systems, are designed to accommodate one or only a few varying product offering and/or shelf sizes. Universal shelving systems having a base and adjustable side walls for use with product packaging of any size and dimension, are not currently available. Such current systems also do not offer such functionality with a pusher having a forward bias for keeping product faced to the front of the shelf.

SUMMARY

The system of the present application includes a display tray assembly having base and center tray sections that are configured to form a gap that receives a side tray section on either side. The side tray sections are configured such that they may move laterally with respect to the base and center tray section in order to adjust the width of the entire display tray assembly to accommodate any size product in a retail environment. In lieu of side tray sections, the display tray assembly may include union tray sections that may engage two separate base and center tray section assemblies in order to create a continuous display tray assembly with adjustable widths.

DETAILED DESCRIPTION

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

Figure 1:
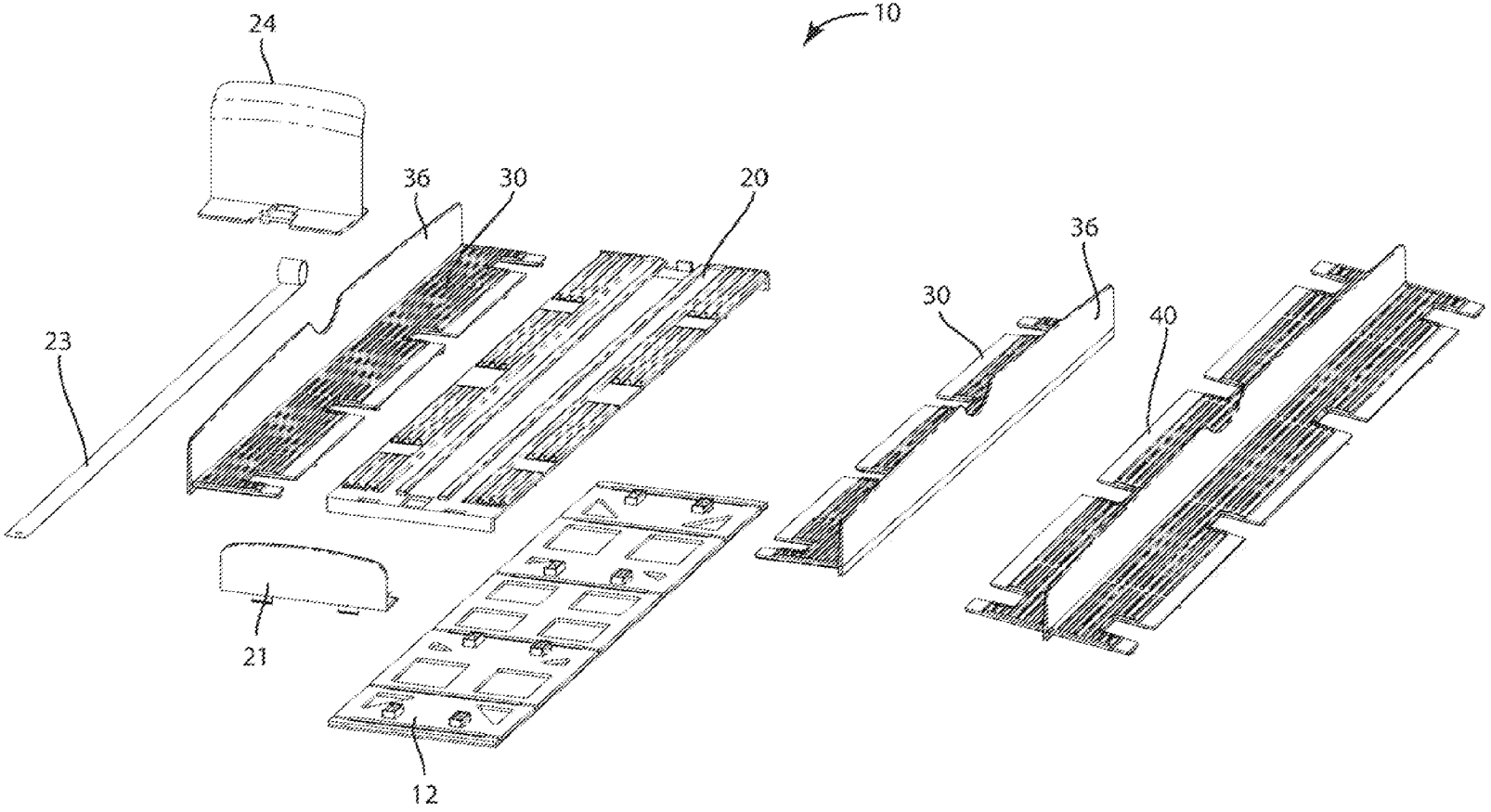
FIG. 1 is a front exploded isometric view of an embodiment of a display tray assembly in accordance with the present invention.

FIG. 1 illustrates one embodiment of a display tray assembly 10. Embodiments of the display tray assembly 10 as disclosed in further herein can be used in a variety of settings including the display of retail products. For the purposes of description, embodiments of the display tray assembly 10 that are adapted for use in a freezer will be described in detail herein; however, this is not intended to be limiting on the scope of display tray assemblies as disclosed herein. Generally, the display tray assembly 10 comprises a center tray section 20 and two side tray sections 30 that are movable with respect to the center tray section 20. Thus, the width of the freezer tray assembly 10 may be increased or decreased depending on certain conditions, e.g., the type of item to be stored on the freezer tray assembly 10 or the size of the freezer in which the freezer tray assembly 10 is mounted.

Figure 2:
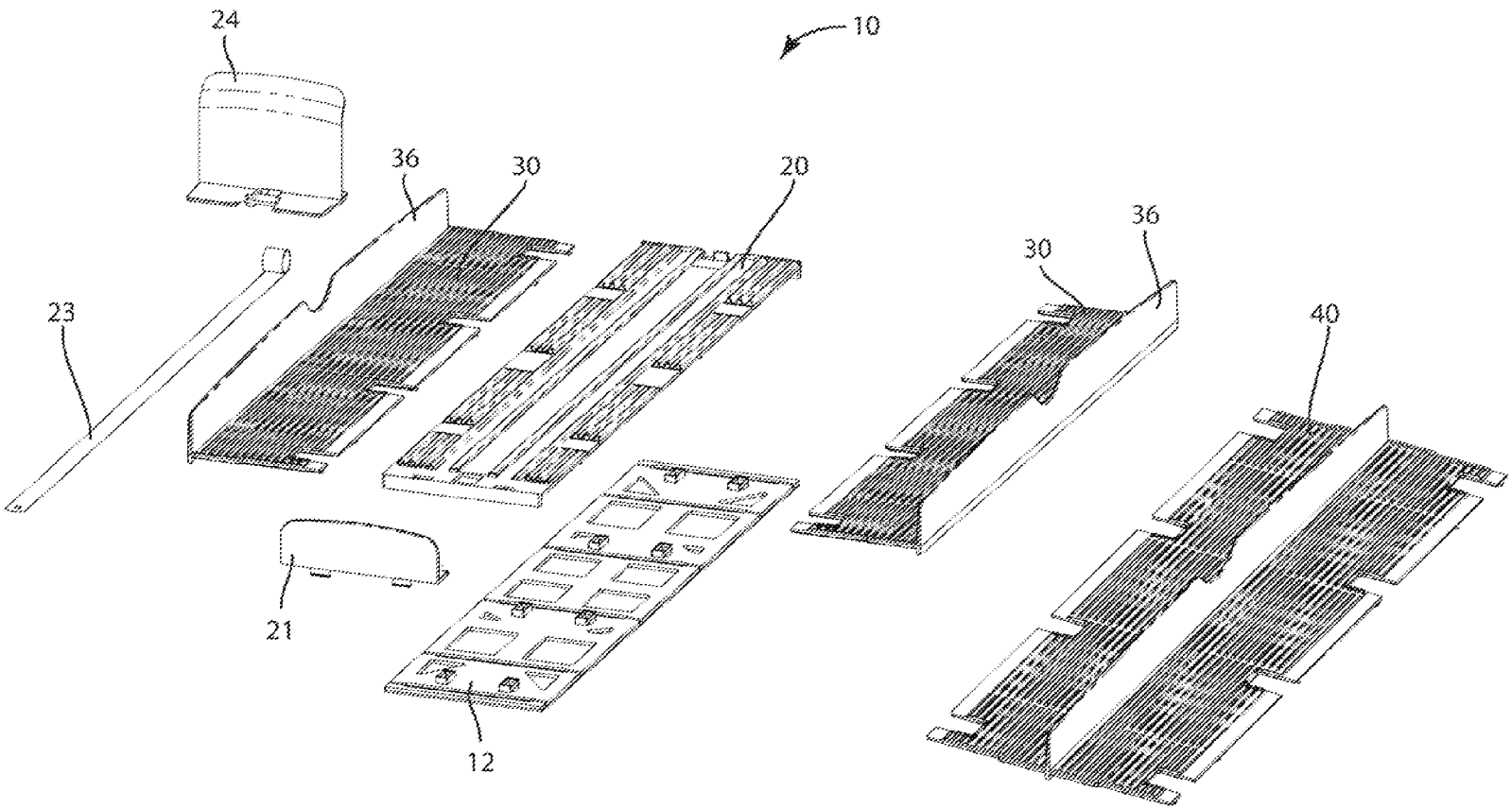
FIG. 2 is a front exploded isometric view of an embodiment of a display tray assembly in accordance with the present invention.
Figure 3A:
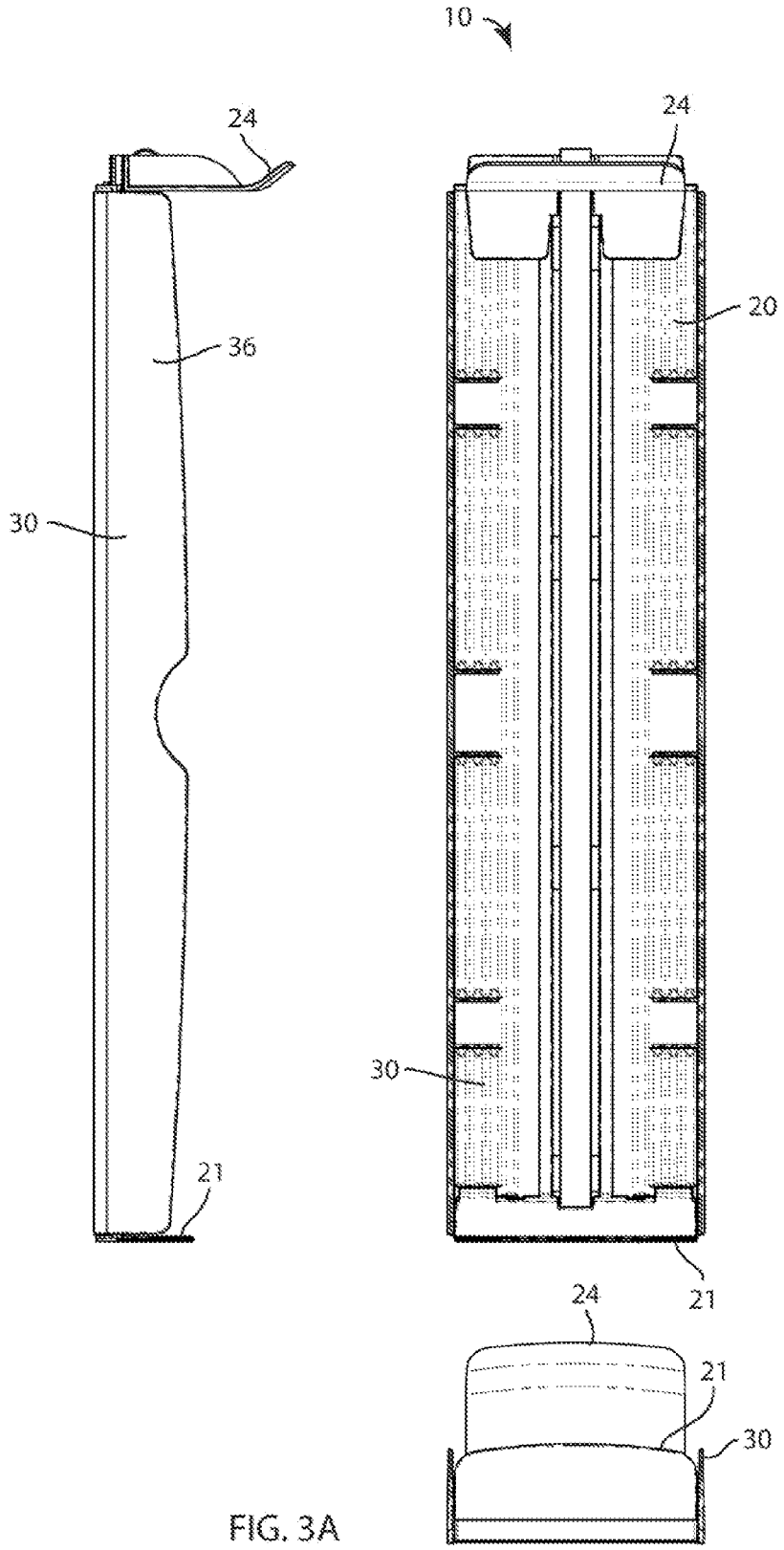
FIG. 3*a* is a top plan view of the display tray assembly of FIG. 1 in the retracted position.
Figure 3B:
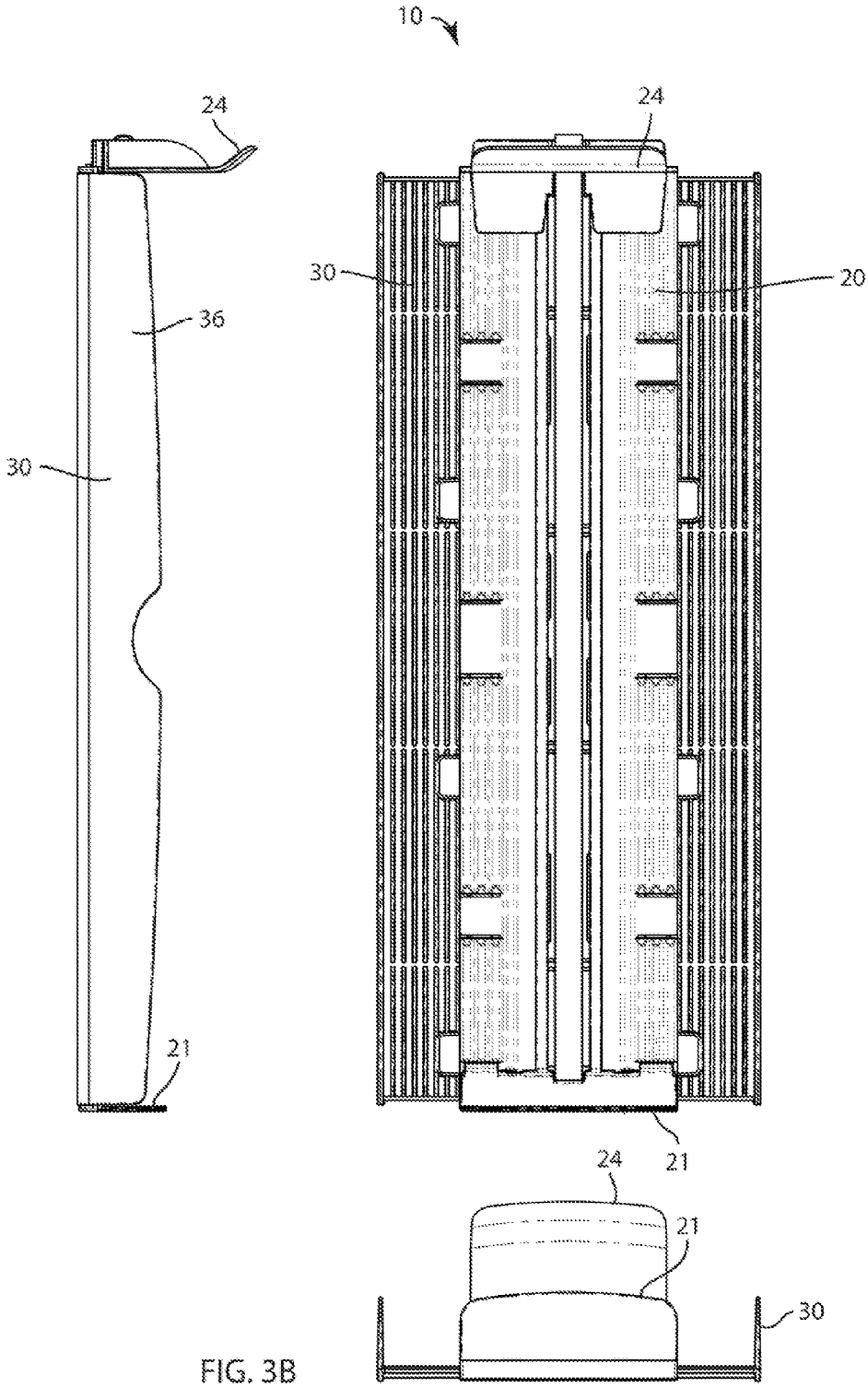
FIG. 3*b* is a top plan view of the display tray assembly of FIG. 1 in the expanded position.
Figure 4A:
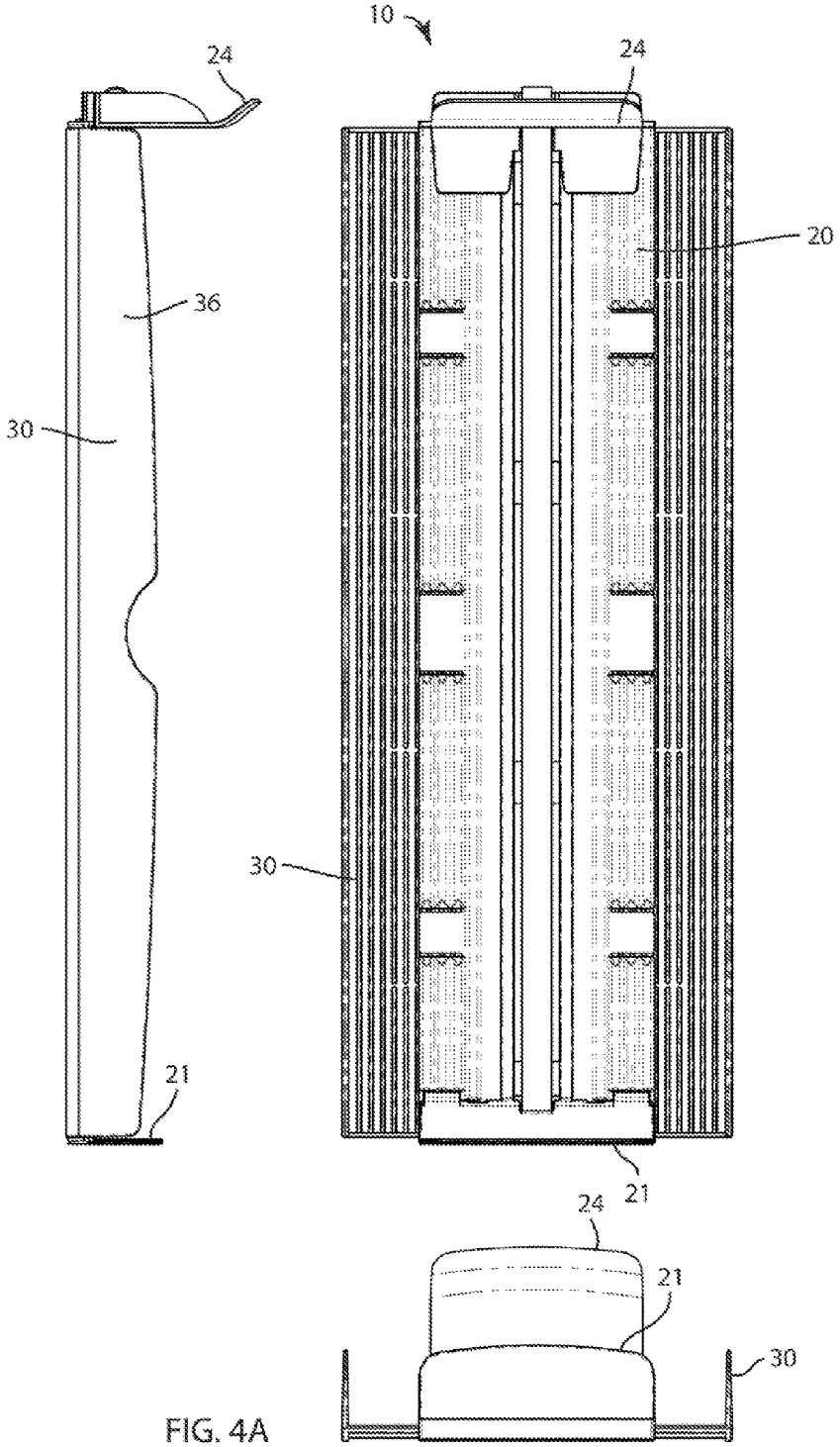
FIG. 4*a* is a top plan view of the display tray assembly of FIG. 2 in the retracted position.
Figure 4B:
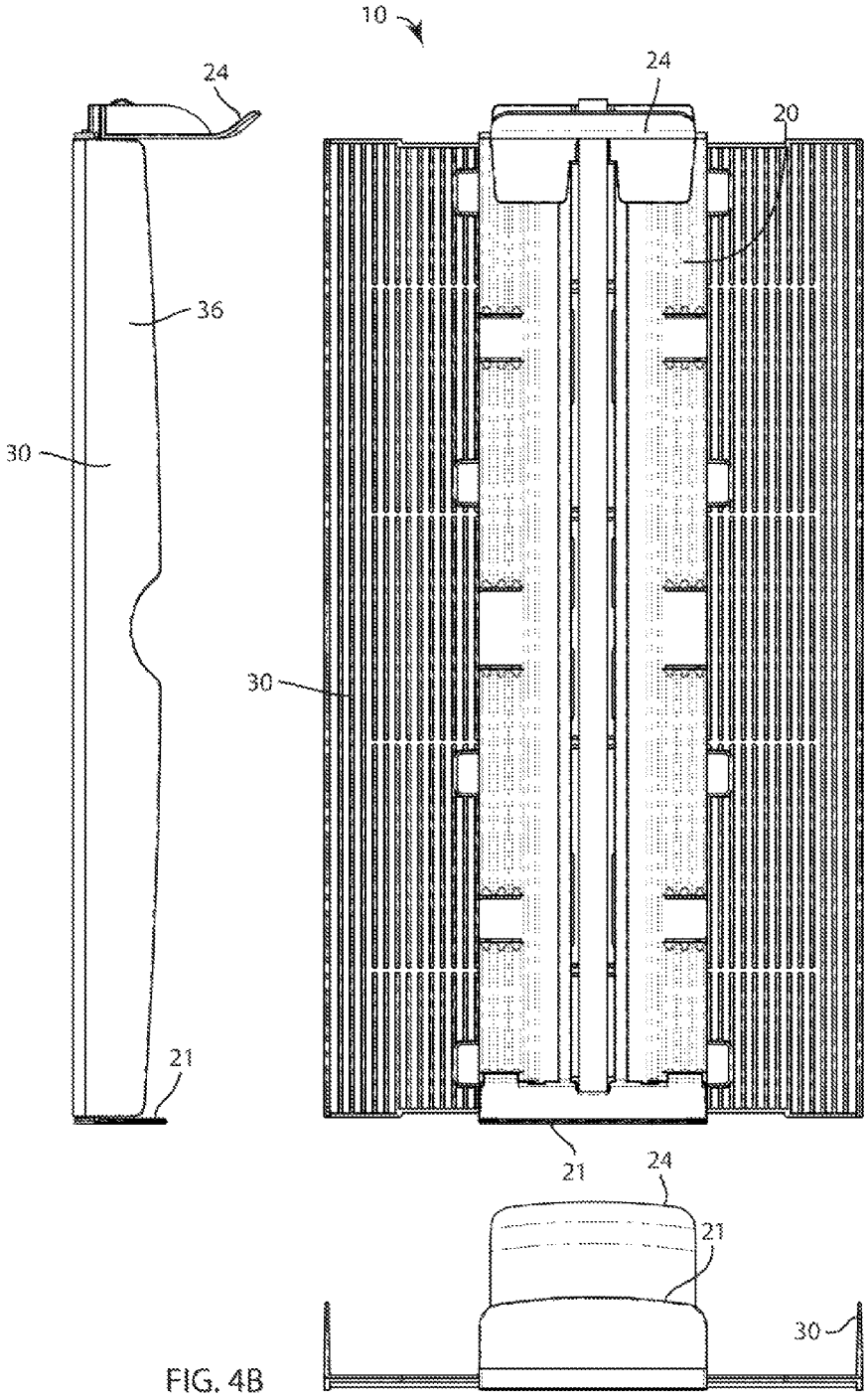
FIG. 4*b* is a top plan view of the display tray assembly of FIG. 2 in the expanded position.

Referring now to FIG. 2, an additional embodiment of the present application includes side tray sections 30 and a union tray section 40 that has a greater width than the embodiment illustrated in FIG. 1. It should be further noted that the embodiments shown in both FIG. 1 and FIG. 2 are exemplary only, and should not limit the claims to side tray sections 30 and union tray section 40 having the widths illustrated in FIGS. 1 and 2. Likewise, FIGS. 3*a* and 3*b* correspond with the embodiment of FIG. 1, and FIGS. 4*a* and 4*b* correspond with the embodiment illustrated in FIG. 2. FIGS. 3*a* and 4*a* illustrate the display tray assembly 10 of each embodiment in a minimum width configuration, or retracted position, while FIGS. 3*b* and 4*b* illustrate the embodiments of the display tray assembly 10 in a maximum width configuration, or extended position. All the sets of figures, FIGS. 3*a, b* and FIGS. 4*a, b*, illustrate exemplary embodiments of the display tray assembly shown in a position that defines the minimum and maximum width of its respective display tray assembly 10, and should not be construed to limit the display tray assemblies 10 to these widths. In other words, the display tray assemblies 10 shown in FIGS. 3*a*-4*b* do not illustrate the infinite amount of positions between the minimum and maximum width configurations that the display tray assemblies 10 can achieve.

Figure 5:
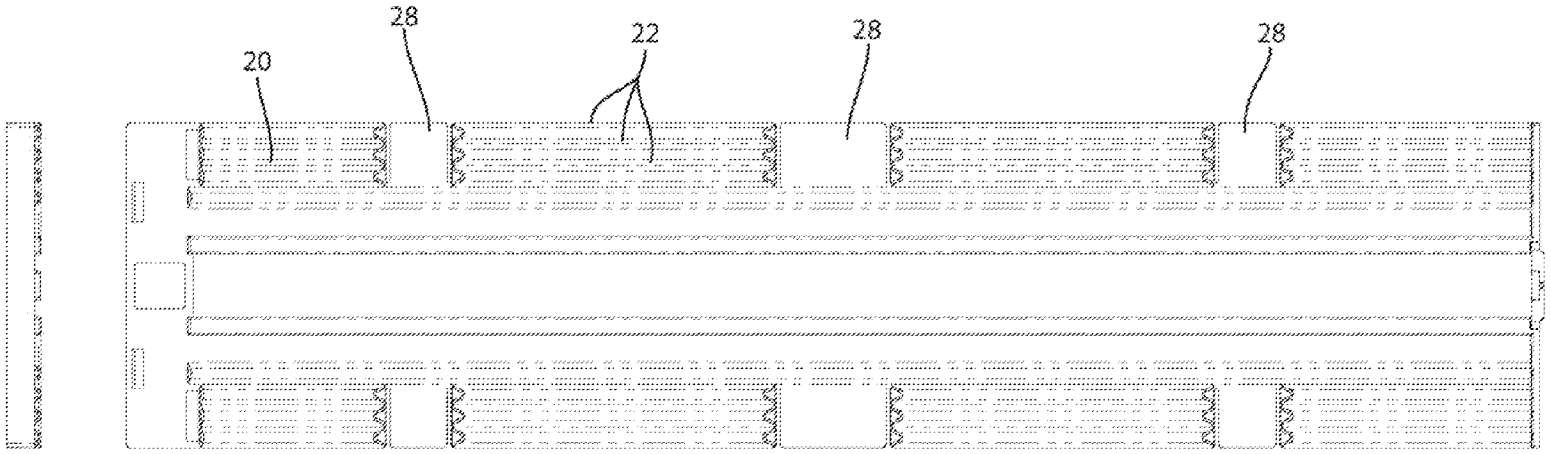
FIG. 5 is a top view of a center tray section incorporated in the display tray assembly of FIGS. 1 and 2.
Figure 6:
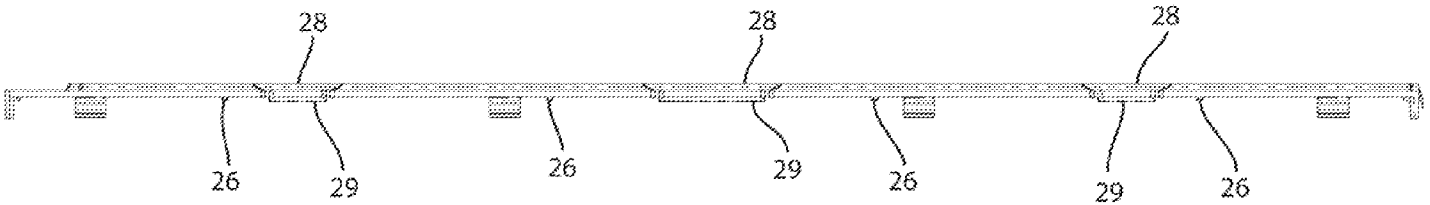
FIG. 6 is a side elevation view of the center tray section of FIG. 5.

As shown in FIGS. 5 and 6, the center tray section 20 may be in the form of a rectangular plate. The center tray section 20 preferably provides a solid floor for the freezer tray assembly 10 in that the surface of the center tray section 20 is substantially free of openings, as opposed to prior art freezer display assemblies that have open areas (such as is the case with mesh-type configurations that feature a number of open areas). A solid floor configuration provides support for less rigid items e.g., bags of frozen vegetables or potato products, in sliding along the freezer tray assembly 10 as the forward items are removed from the freezer tray assembly 10 by consumers. It is also contemplated, however, that the floor of center section 20 may be provided with slots or holes that are sized and configured so as not to catch the items as they are moved forwardly on the freezer try assembly 10. The slots or holes in the floor of center section 20 are designated to accommodate the flow of air within the freezer while providing unobstructed movement of the frozen items on freezer tray assembly 10.

Still referring to FIGS. 5 and 6, the center tray section 20 has a number of raised, axial ridges 22 that support items placed on the center tray section 20. The ridges 22 are substantially parallel to one another and run along a longitudinal axis of the center tray section 20. The ridges 22 are preferably equidistantly spaced from one another. The ridges 22 are preferably rounded, i.e., each ridge 22 has a radiused top surface. However, any suitable shape may be used for the ridges 22, so long as the ridges 22 are able to support the items on freezer try assembly 10 and facilitate (and do not hinder) the sliding of the items along the freezer tray assembly 10. Alternatively, some embodiments of the center tray section 20 may have no ridges 22 at all.

Figure 12:
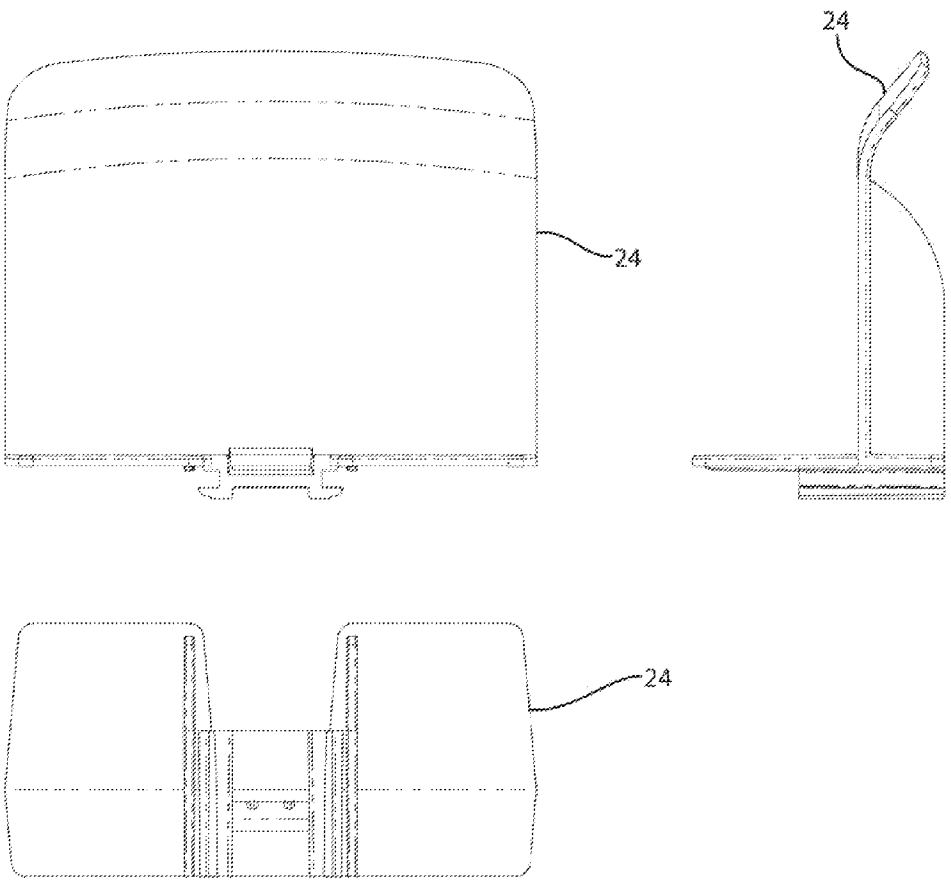
FIG. 12 is an isometric view of a pusher incorporated in the display tray assembly of FIGS. 1 and 2.

In the illustrated embodiment of FIGS. 5 and 6, the ridges 22 are separated into two groups on either side of the center tray section 20. The space defined between the two groups of ridges 22 accommodates a pusher 24 and bias element 23, e.g., a coil spring, that secures items on the freezer tray assembly 10 and also pushes the items supported on the center tray section 20 to the front of the freezer tray assembly 10 (i.e., the end of the tray proximate the freezer door) as other items are removed by consumers. The freezer tray assembly is stocked by a retail employee by overcoming the force applied by the pusher 24 to insert new product into the freezer tray assembly. The pusher 24 and bias element 23 are further illustrated in FIGS. 12 and 13.

Figure 15:
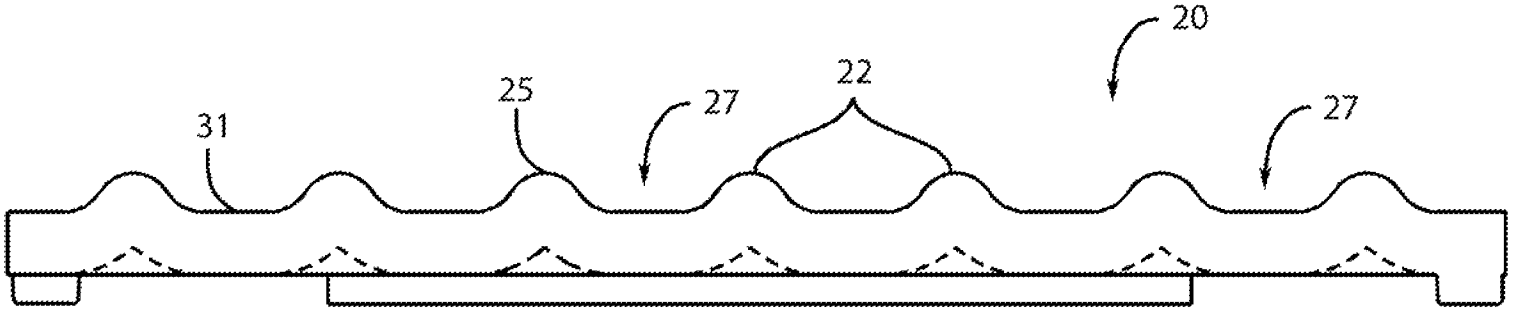
FIG. 15 is a cut away view of an embodiment of the center tray section of FIG. 5.

FIG. 15 is a partial cutaway view taken along line 15-15 in FIG. 5. As shown in FIG. 15, the top surface of the center tray section 20 comprises a plurality of ridges 22 that have a wave-like configuration that defines the ribs 22. Each rib 22 has a convex shape that defines a peak 25, i.e., the highest part of the rib 22, which contacts the bottom surface of a container resting on the ribs 22. Between the ribs 22 are valleys 27. The valleys 27 merge with the sides of the ribs 22, and have a concave shape. In the illustrated embodiment, the center tray section 20 has a plurality of ribs 22 that support the container or package, and valleys 27 between the ribs 22. Any number of ribs 22 and valleys 27 may be used as desired, in order to provide the optimal balance between a desired low degree of friction as provided by the disclosed center tray section 20 design and the weight and pressure of the container or package.

In one exemplary embodiment, the ribs 22 are spaced apart by a distance (as measured between the peak 25 of two adjacent ribs 22) of between about 2% and about 6% of the width of the center tray section 20. In one embodiment, the ribs 22 are spaced apart by a distance of about 4% of the width of the center tray section 20. In still further non-limiting embodiments, the ribs 22 are spaced apart by a distance of between about 10% and 20% of the width of the center tray section 20. It is understood, however, that the ratio of the width between the ribs 22 and the width of the center tray section 20 may vary according to the parameters of the containers or packages, including weight, bottom footprint, configuration of the portion of the container or package that rests on the ribs, etc. The ribs 22 are spaced so as to minimize the number of contact points with the container, which minimizes friction and facilitates sliding of containers along the plurality of ribs 22. In addition, the spacing between the ribs 22 makes it easy to clean the glide strip. Specifically, the concave configuration of the valleys 27 and the convex configuration of the ribs 22 provide a smooth cross-section, without sharp corners or crevices, within which contaminants can be trapped. This feature provides for easy cleaning of embodiments of the freezer tray assembly 10.

In the illustrated embodiment, the height of the ribs 22 is between about 0.01 inch and about 0.1 inch, and more preferably, about 0.06 inch although the height of the ribs may vary for different containers or packages. The distance between the ribs 22 is between about 0.2 inch and about 0.5 inch, and more preferably, about 0.3 inch although again the spacing of ribs 22 may vary for different containers or packages. In an embodiment, the convex top of each rib 22 is preferably rounded, having a radius of curvature between about 0.05 inch and about 0.125 inch, which in a further embodiment is about 0.06 inch. The concave rounded side walls of the ribs 22 exemplarily have a radius of curvature between 0.05 inch and about 0.2 inch, and in one non-limiting embodiment, about 0.125 inch. As further depicted in FIG. 15, in an embodiment of the center tray section 20 the bottom of each valley 26 has a portion 31 that is substantially flat. This substantially flat portion 31, in an embodiment, has a width of between about 0.5 inch and about 0.15 inch, in a further embodiment, the substantially flat portion 31 is about 0.1 inch. In a still further non-limiting embodiment, the substantially flat portion 31 is between about 0.03 inch and about 0.09 inch.

As disclosed above, and in further detail herein, the plurality of ribs 22 minimizes the surface area that is in contact with a bottom surface of a container supported by the plurality of ribs 22. In particular, the radiused peak of each rib 22 provides point-type contact that significantly reduces contact surface area, while not digging into or otherwise damaging the material of the container, and without the package or container digging into, or otherwise damaging the material of the ribs 22 themselves, as could occur with ribs that have a more pointed construction. The radiused peak of each rib 22 functions to deflect or route pressure or stress on the rib 22 from the package or container radially downwardly to the valleys 27, much in the same manner as is accomplished by a Roman arch design. This cross-sectional configuration of the ribs 22 functions to dissipate the force and pressure from the container or package into the valleys 27, and decreases pressure and rib deformation or creep from the weight of the container or package, which greatly enhances the ability of the containers or packages to move along the ribs when a force is applied. Creep is undesirable because it presents increased friction between a container and its supporting surface and thereby can inhibit the sliding movement of the containers along a shelf or other support structure. By eliminating creep, as mentioned above, the center tray section 20 as disclosed reduces the force required to translate containers or packages along the center tray section 20.

At least an upper surface of the center tray section 20 as disclosed herein may be formed of a low friction material, which further facilitates the forward sliding movement of containers along the plurality of ribs 22. Exemplarily, the upper surface of the glide strip 10 may be formed of a Teflon material such as a DuPont Teflon® grade 7B granular compression molding resin or an ABS plastic material incorporating a low friction agent such as Siloxane, although it is understood that any other satisfactory low friction material may be employed. The center tray section 20 may be overmolded, coated, sprayed, or simply made of low friction material. Alternatively, the center tray section 20 may be made of a material that includes a low friction additive such, but not limited to, Teflon.

This disclosed embodiment of the center tray section 20 is, in embodiments, dimensioned particularly for the types of containers or packages with which the freezer tray assembly 10 will be used. This design provides optimal operation by including any number of ribs 22 greater than two to be in contact with the bottom of the container or package, according to container variables including container type (flexible or rigid), weight, surface area, material, and finish.

Embodiments of the center tray section 20 as disclosed herein provide additional advantages for use in retail merchandising applications. The plurality of ribs 22 are easy to clean by virtue of the ungulate wave-like concave-convex configuration of valleys 27 and ribs 22, without the presence of sharply angled corners, cracks or crevices within which dirt, spillage, or bacteria tend to be trapped. The design of embodiments provide a superior low drag surface that provides further advantages as will be described in further detail herein.

Figure 14:
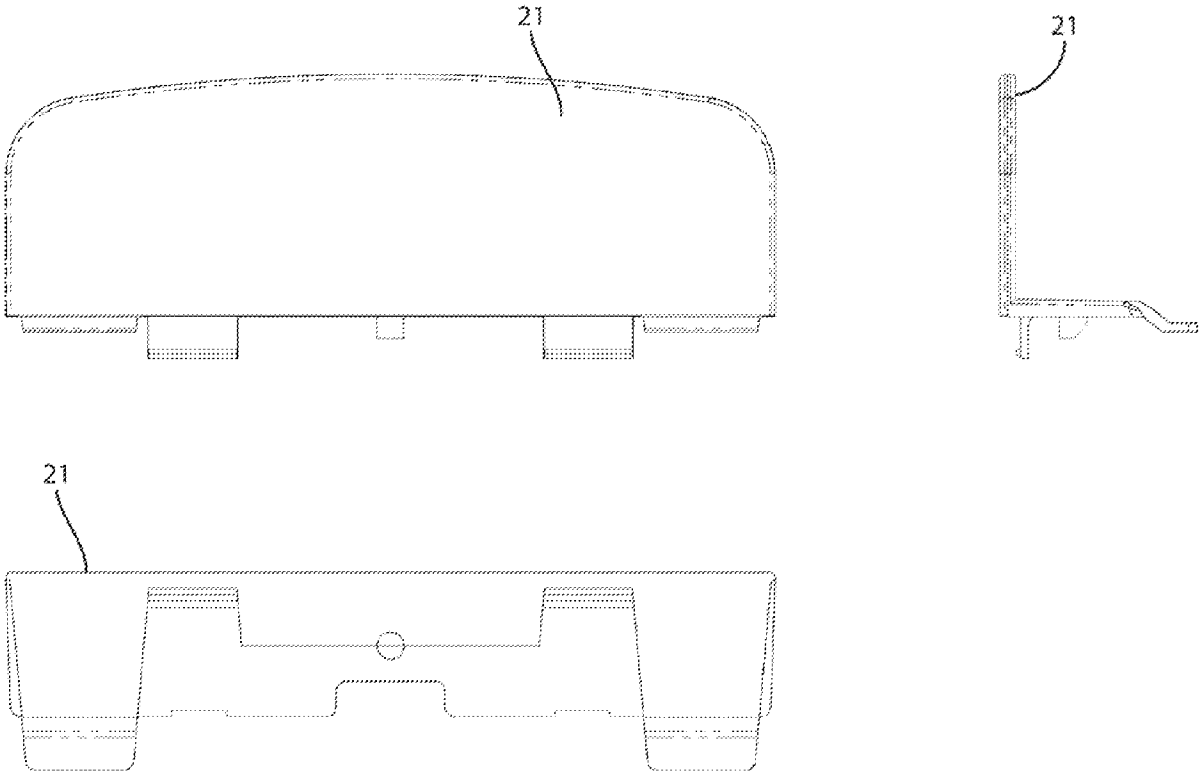
FIG. 14 is a front elevation view of a fence or end wall incorporated in the display tray assembly of FIGS. 1 and 2.

Referring back to FIGS. 1 and 2, the center tray section 20 further includes a fence 21 that prevents items from falling (or being pushed by the pusher 24) off the end of the freezer tray assembly 10. A number of views of an exemplary fence 21 are illustrated in FIG. 14.

Figure 11:
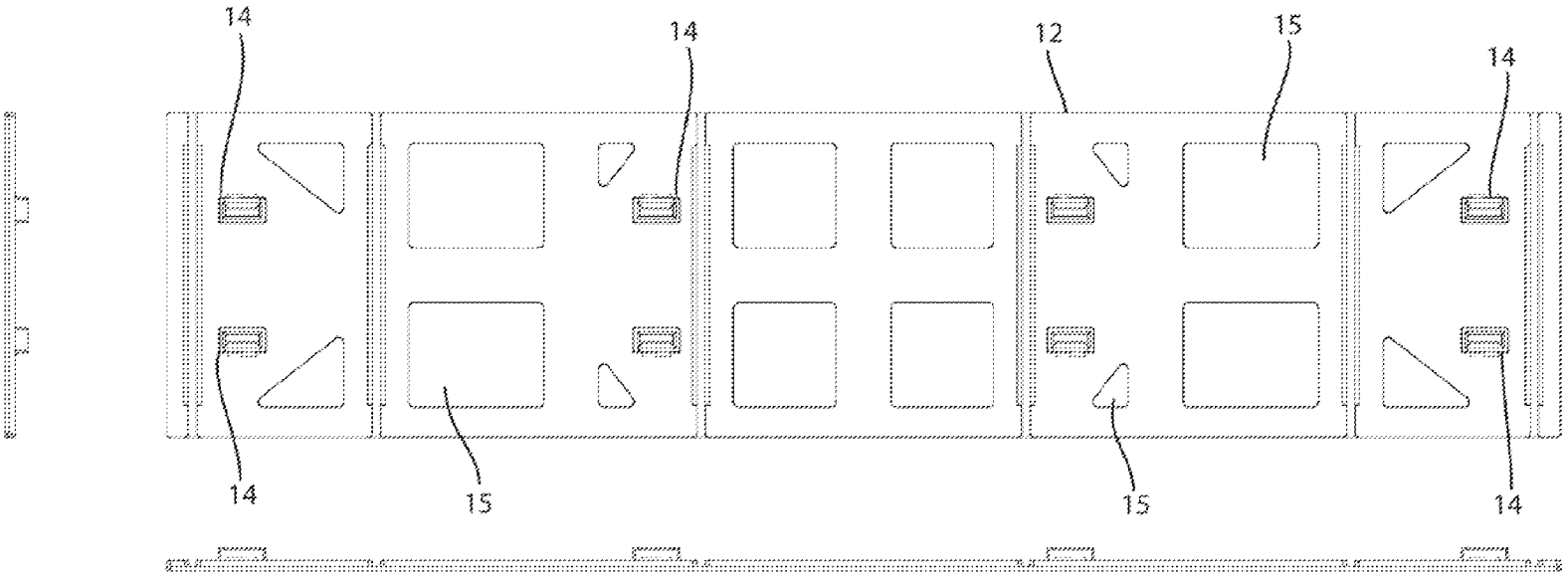
FIG. 11 is a top plan view of a base incorporated in the display tray assembly of FIGS. 1 and 2.

The center tray section 20 is secured to a base 12, which provides stability to the freezer tray assembly 10 and also functions support the freezer tray assembly 10 on a shelf or other supporting structure within a freezer. As shown in FIG. 11, the base 12 has a series of lugs 14 that define openings for receiving fasteners, e.g., snaps or the like, that secure the center tray section 20 to the base 12. The base 12 may be in the form of a rectangular plate that has a series of apertures 15. The apertures 15 are of such a shape and size so as to reduce the amount of material needed to manufacture the base 12 without compromising its structural integrity. When secured together, the center tray section 20 and the base 12 form gaps within which the side tray sections 30 are received.

Figure 7A:
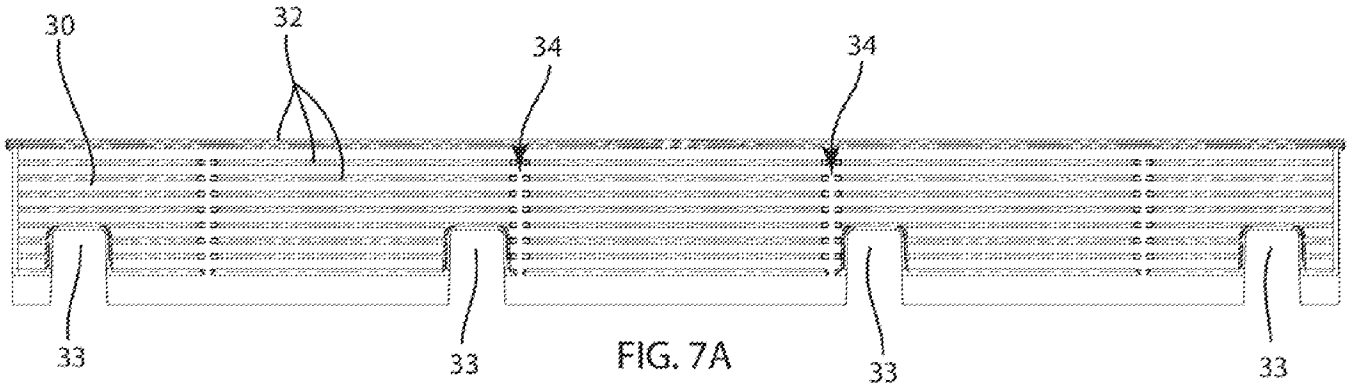
FIG. 7*a* is a top plan view of an embodiment of a side tray section incorporated in the display tray assembly of FIG. 1.
Figure 7B:
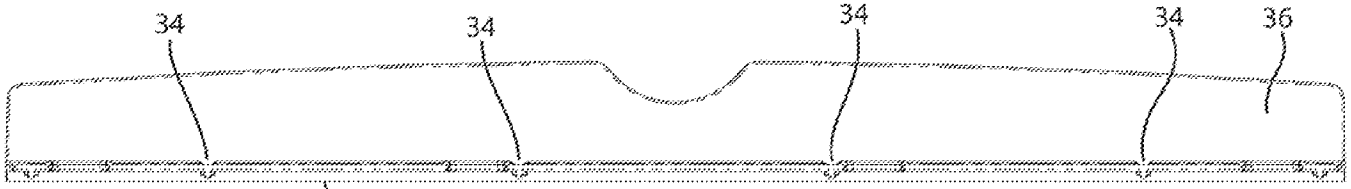
FIG. 7*b* is a side elevation view of the side tray section of FIG. 7*a;*

Two examples of side tray sections 30 are shown in FIGS. 7*a, b* and 8*a, b*. The embodiment illustrated in FIGS. 7*a* and 7*b* correspond to the first exemplary embodiment of FIG. 1, and the embodiment illustrated in FIGS. 8*a* and 8*b* correspond to the second exemplary embodiment of FIG. 2. It should be noted that in the illustrated configurations there are side tray sections 30 positioned on either side of the center tray sections 20. Thus, there may be right side tray sections 30 and left side tray sections 30. However, the preferred design is such that the side tray sections 30 may be used on either the left side or the right side of the center tray section 20, i.e., there is no difference in design between left side trays 30 and right side trays 30. In this manner, the side tray sections 30 are modular and interchangeable components of the freezer tray assembly 10.

Figure 8A:
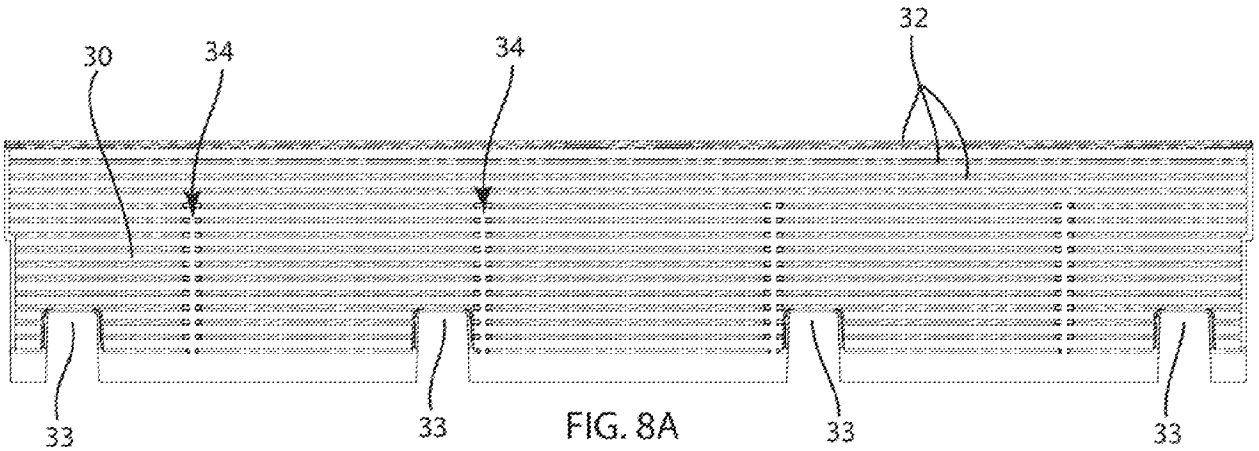
FIG. 8*a* is a top plan view of an embodiment of a side tray section incorporated in the display tray assembly of FIG. 2.
Figure 8B:
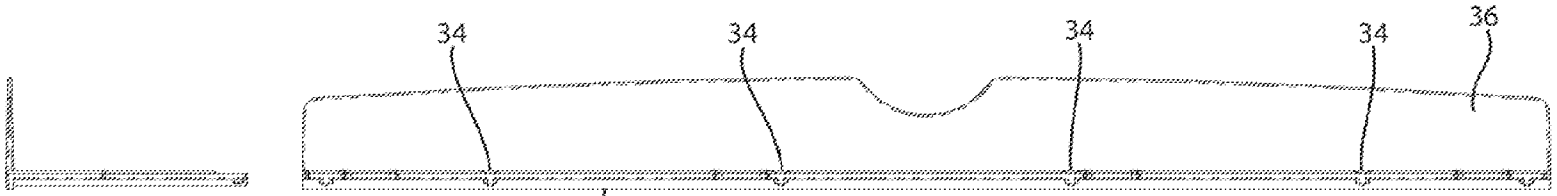
FIG. 8*b* is a side elevation view of the side tray section of FIG. 8*a;*

As shown in FIGS. 7*a* and 8*a*, side tray sections 30 are in the form of a rectangular plate, having a similar thickness and length as the center tray section 20. The side tray sections 30 have raised ridges 32 that are of similar size, of similar orientation, and similarly spaced as the ridges 33 of the center tray section 20. Therefore, in an embodiment, a cross-section through the side tray section 30 appears the same or similar to that depicted in FIG. 15. The side tray section 30 further include notches 33 in the edge of the side tray sections 30 that are proximate the center tray section 20. The lugs 14 of base 12 are received within notches 34, and function to guide movement of the side tray sections 30 relative to the center tray section 20. Thus, when the side tray sections 30 are moved relative to the center tray section 20 and the base 12, the lugs 14 provide front-to-back alignment of the side tray sections 30, to prevent side tray sections 30 from skewing when the side tray sections 30 are moved inwardly and outwardly relative to center tray section 20.

Still referring to FIGS. 7*a* and 8*a*, the ridges 32 of the side tray sections 30 have intermittent breaks or gaps that form a plurality of grooves 34. The grooves 34 correspond with guides 26 that extend beneath the center tray section 20, as further illustrated in FIG. 6. Thus, as the side tray sections 30 move relative to the center tray section 20, the guides 26 slide along the grooves 34 to guide the side tray sections 30 and to ensure that the side tray sections 30 move uniformly in a front-to-back direction so as to prevent the side tray sections 30 from skewing relative to the center tray section 20.

In these illustrated embodiments, the center tray section 20 has a plurality of clips 28 that secure the side tray section 30 at a discrete lateral position with respect to the center tray section 20. As shown in FIG. 5, each clip 28 is formed by slots in the center tray section 20 that extend perpendicular to a side edge of the center tray section 20. Each clip 28 has a downwardly extending lip 29 that normally resides in a first position. In operation, the downwardly extending lip 29 engages and secures the side tray section 30 by extending into a space between two adjacent tracks 32. When the side tray is moved as desired, the tracks 32 flex the lip 29 (and thus the clip 28) upwardly into a second position that allows the track 32 to pass beneath it. Once the lip 29 has moved over the track 32, the lip 29 returns to the first position and settles into the adjacent space. Thus, the side tray 30 is moved amongst a plurality of discrete positions that correspond with the spaces between the tracks 32.

In another embodiment, the side trays 30 are received within the space provided between the base 12 and the center tray section 20. The lugs 14 of the base 12 provide a spacing between the base 12 and the center tray section 20. This space is dimensioned to approximate the thickness of the side tray section 30 so that the side tray section 30 is sandwiched between the base 12 and the center tray section 20. The side tray section 30 is thus infinitely positionable laterally with respect to the center tray section 20 while the engagement of the lugs 14 of the base 12 with the notches 33 maintain alignment of the side tray section 30 and the center tray section 20 as described above.

The side tray section 30 preferably has a fence or side wall 36 that is vertically oriented and extends along a longitudinal axis of the side tray section 30. The side wall 36 helps to secure items on the freezer tray assembly 10, and to guide items as they are moved on the freezer tray assembly 10. The side wall 36 may be integral with side tray section 30, or it may be a separate, removable component.

In the embodiment shown in FIGS. 3*a* and 3*b*, the width of the side tray section 30 is about half the width of the center tray section 20. Thus, a freezer tray assembly 10 that includes a center tray section 20 and two side tray sections 30 has a wide range of adjustably in terms of surface area for storing items. In one embodiment, the width of the freezer tray assembly 10 can range from at the smallest (in the fully retracted position in FIG. 3*a*) the width of the center tray section 20 to at the largest (in the fully extended position in FIG. 3*b*) approaching twice the width of the center tray section 20. As discussed above, in one embodiment the overall width of the freezer tray assembly 10 can be varied along increments that correspond with the spaces between the tracks 32 of the side tray sections 30. Such an embodiment is illustrated in FIGS. 4*a* and 4*b*. It should be noted that an alternate system may be used to secure the side tray sections 30 within the assembly. Alternatively, the clips 28 may be eliminated to allow for infinite adjustment in the width of the freezer assembly 10 (as opposed to the discrete number of widths when the clips 28 are utilized).

In the alternative embodiment described above that includes the functionality of infinite adjustment of the width of the freezer assembly 10, two additional advantages may be observed. First, some infinitely adjustable embodiments provide an improved user experience when setting up and stocking freezer tray assemblies 10 of these embodiments. The infinitely adjustable nature of the embodiment allows the width of the freezer tray assembly to be expanded for receiving containers or packages. After the freezer tray assembly has been loaded with product, the side tray sections 30 are adjusted to a minimum or other desired width.

Secondly, other infinitely adjustable embodiments of the freezer tray assembly maximize the use of space when a plurality of freezer tray assemblies 10 are used within a freezer or across a shelf. Since the side tray sections 30 move freely with respect to the center tray section 20 in an infinitely adjustable manner, the width of the freezer tray assembly 10 can be minimized specifically to the dimensions of the products stored within the freezer tray assembly 10. This is to be contrasted with embodiments wherein the freezer tray assemblies are only adjustable incrementally. Since the increments are set to standardized spaces, a user must consistently select a larger freezer tray assembly width than is ultimately needed in order for the product to fit within the freezer tray assembly. The elimination of the incremental adjustments, allows the user to minimize the width of each freezer tray assembly to the product contained within that specific freezer tray assembly 10. Over the course of an entire freezer or shelf, this can add valuable product facings.

Figure 9A:
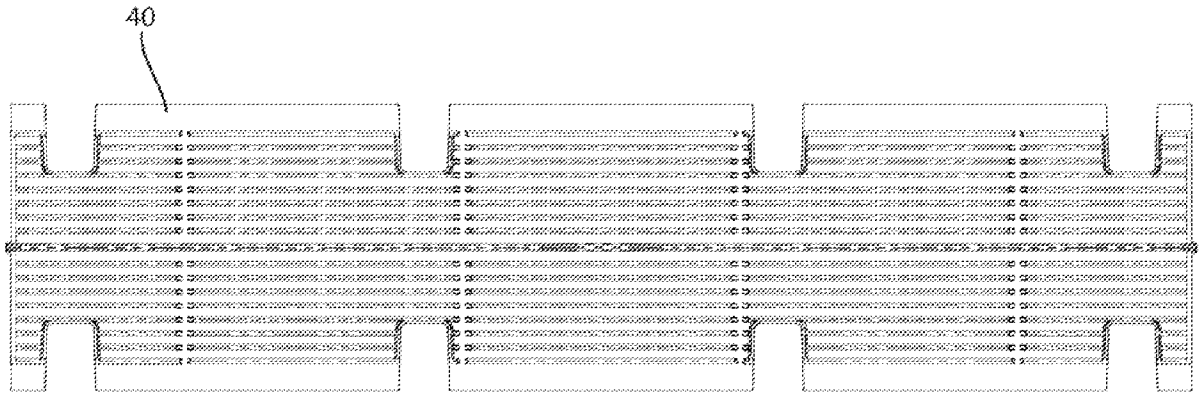
FIG. 9*a* is a top view of an embodiment of a union tray that may optionally be incorporated in the display tray assembly of FIG. 1.
Figure 9B:
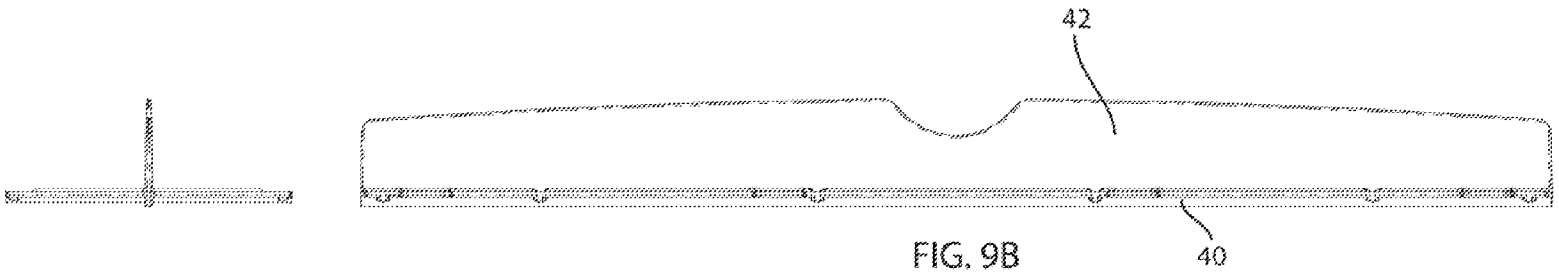
FIG. 9*b* is a side elevation view of the union tray of FIG. 9*a;*
Figure 10A:
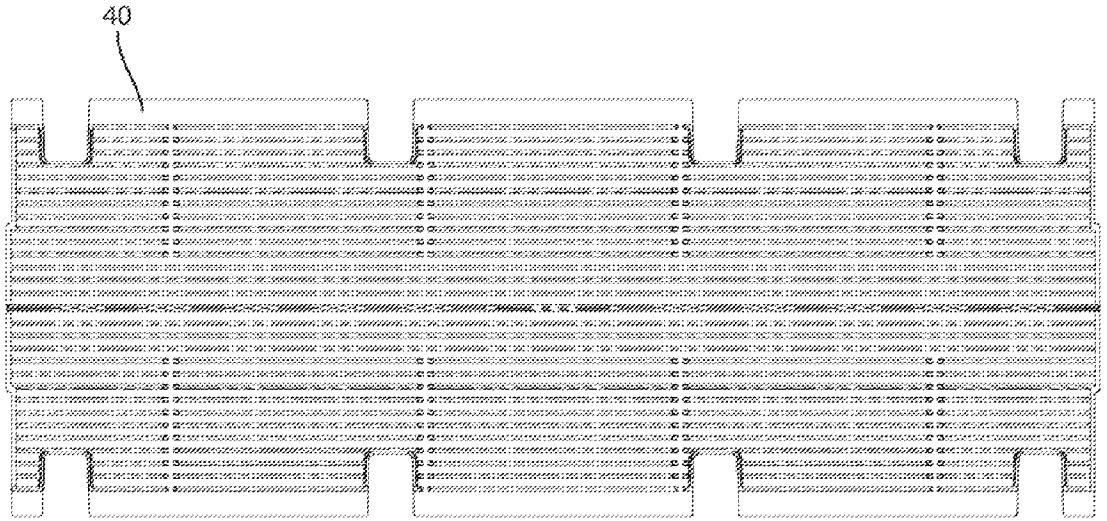
FIG. 10*a* is a top view of an embodiment of a union tray that may optionally be incorporated in the display tray assembly of FIG. 2.
Figure 10B:
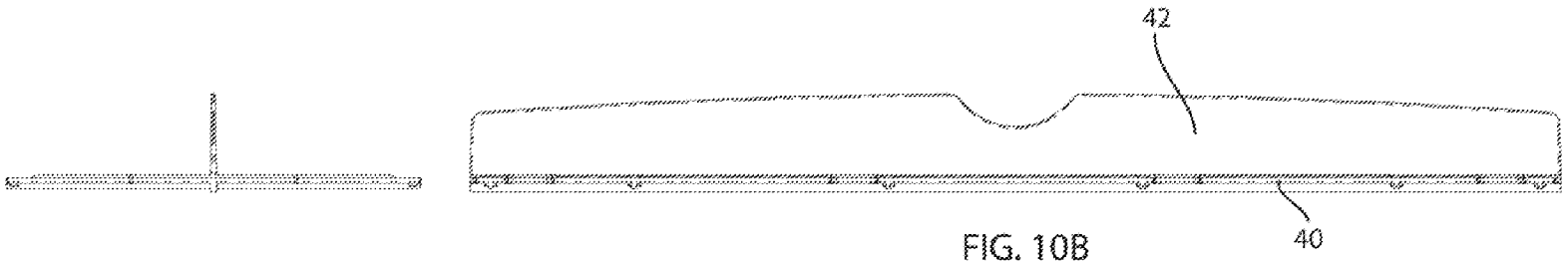
FIG. 10*b* is a side elevation view of the union tray of FIG. 10*a;*

In an alternative embodiment, a union tray section 40 may be used between two adjacent center tray sections 20, such as in the place of one or more adjacent side tray sections 30. As shown in FIGS. 9*a, b* and 10*a, b*, the union tray section 40 is comprised of two side tray sections 30 that are joined along their respective inner edges, i.e., the edges that do not have notches 33. The union tray section 40 has a center wall 42 that is used to form adjacent rows for storing items within the freezer. Thus, the union tray section 40 may slide laterally between the adjacent center trays 20 whereby the lateral motion of the center wall 42 caries the width of the adjacent rows. The center wall 42 of the union tray section 40 can thus be used with adjacent freezer tray assemblies 10, in order to provide a single divider wall between adjacent tray assemblies 10, thus eliminating a double wall thickness resulting from two adjacent tray assemblies placed side-by-side.

The freezer tray assembly 10 of the present invention may include any desired combination of center tray sections 20, side tray sections 30 and union tray sections 40. These components are modular and interchangeable so that a specific freezer tray assembly 10 may be assembled to accommodate a variety of freezers and products. The various components of the freezer tray assembly 10 may be made of any suitable material. Preferably the components of the freezer tray assembly 10 are made from injection molded high-density polyethylene (HDPE) and, although it is understood that any other satisfactory material may be employed.

The freezer tray assembly 10 of the present disclosure accomplishes a number of desirable objectives in the retail display of frozen products. By providing a solid floor, the freezer tray assembly 10 insures that items are reliably moved forwardly toward the front of the freezer when a forwardmost item is removed. This reduces door opening times, which can result in significant savings in energy costs. The adjustable side tray sections 30 allow the freezer tray assembly to have virtually any desired width, which can accommodate the vast majority of frozen products such as frozen vegetables, frozen potato produces and frozen entrées. Adjacent freezer tray assemblies 10 can be chained together using union tray sections 40, to effectively form a unitary tray structure that can extend any desired width within a freezer. This is particularly advantageous, in that the products supported by all of the interconnected freezer tray assemblies 10 function as ballast to prevent unwanted movement of the freezer tray assemblies within the freezer. The freezer tray assembly 10 is preferably formed of a material, such as HDPE, which is capable of withstanding low temperature environments such as are found in supermarket freezers, and the construction of the freezer tray assembly 10 is such that the various pieces and parts are capable of operating in such an environment. Typically, however, the fence 21 will be formed of a clear material to provide product visibility.

Referring again to FIGS. 1-4*b*, in further embodiments, the combination of particular features as disclosed herein can provide additional features. As described above, the center tray section 20, side tray sections 30, or union tray sections 40 can be specifically designed with a plurality of ridges 22 and valleys 27 that are designed and arranged as described above to reduce a coefficient sliding friction between the product and the surfaces. The further disclosed combinations of low friction materials can further reduce this friction while also giving the freezer tray assembly improved durability.

Figure 13:
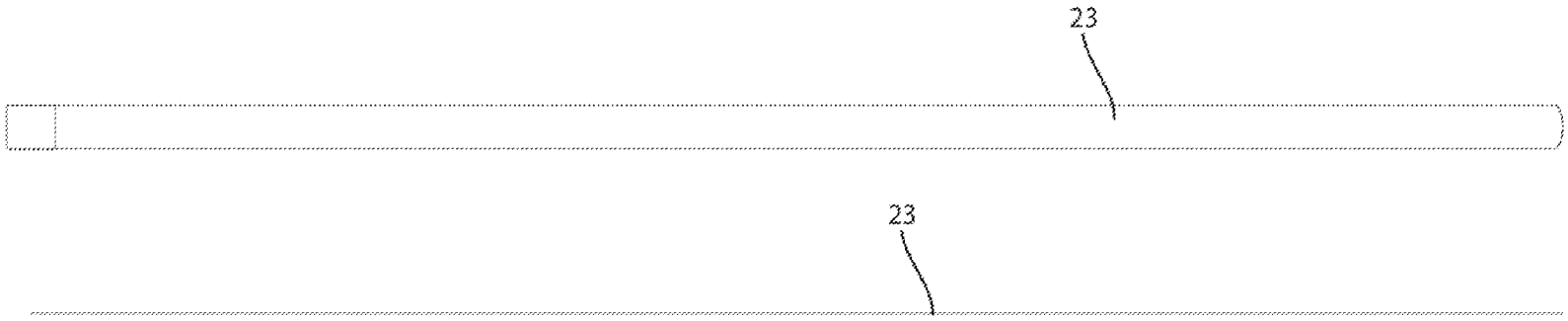
FIG. 13 is a top view of a bias element, in the form of a coil spring, incorporated in the display tray assembly of FIGS. 1 and 2 for biasing the pusher forwardly.

In an embodiment, such as that depicted in FIGS. 1 and 2, a pusher assembly 24 is used to progressively face the product by moving the product along the freezer tray assembly 10 and into contact with the fence 21. A coil spring 23 provides the force to achieve this automated facing. One such spring that may be used in embodiments is a variable force spring such as is available from Vulcan Spring and Mfg. Co. of Telford, Pa. An exemplary spring 23 is illustrated in FIG. 13. The design of variable force coil springs allow for the spring to provide varying degrees of force at different stages of extension along the freezer tray assembly 10. Thus, greater force can be achieved when the coil spring is fully extended, such as when the freezer tray assembly 10 is filled with product and this increased force can be translated through the pusher assembly 24 to the entirety of the containers placed within the freezer tray assembly to force all of the containers forward against the fence 21. However, when only one or a few containers remain within the freezer tray assembly 10, the variable force coil spring 23 is designed to apply a minimized force to keep the remaining container or containers faced within the freezer tray assembly 10.

In an embodiment of the freezer tray assembly 10 that combines the disclosed ridges 22 and valleys 27 for reduced friction with the variable force spring 23, the result is that a smaller spring with reduced variable forces at each stage of the variable force spring cannot be used. In some embodiments, a reduction of required force of 20% or more can be achieved with this combination of structural features. The reduction of the force required in the variable force spring may be achieved by adjusting the gauge, girth, or the tightness of the coil in the coil spring.

The practical effect of this embodiment is an improved stocking and consumer experience when interacting with the freezer tray assembly embodiments. Reduced spring force improves the stocking experience as less force is required by store personnel to overcome the pusher assembly 24 in order to fill the freezer tray assembly with product. The consumer experience is also improved as the force applied by the variable force spring 23 can further be reduced such that the products are easily removed from the freezer tray assembly by the consumer. As the pusher assembly 24 places a compressive force upon the product between the pusher 24 and the fence 21, this applied force can make removal of product difficult for some consumers. Furthermore, when the last or one of the last of the products remaining in the freezer tray assembly 10 is removed by the consumer, some embodiments of freezer tray assembly can experience "snapping" wherein the coil spring 23 moves the pusher 24 into a forwardmost position, sometimes in contact with the fence 21. By minimizing the force applied to the pusher assembly 24, this experience can be minimized or eliminated.

This written description uses examples to disclose the invention, including the best mode, and also to enable any person skilled in the art to make anew the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A display tray assembly comprising:

a base extending in a horizontal dimension;

a center tray section extending in the horizontal dimension fixedly secured to the base at a position above the base to form a gap therebetween;

a side tray section extending in the horizontal dimension and movably positioned at least partially in the gap, the side tray section and the center tray section at least partially defining a product support area, wherein the side tray section is movable with respect to the center tray section so as to adjust a width of the product support area;

a vertically extending sidewall secured to the side tray section;

a union tray section extending in the horizontal dimension, a portion of the union tray section is movably positioned in the gap between the center tray section and the base, and the union tray section and the center tray section at least partially define the product support area; and a vertically extending center wall secured to the union tray section along a center line oft union trap section;

wherein the union tray section is moveable with respect to the center tray section so as to adjust the width of the product support area and the width of the product support area is a distance between the sidewall and the center wall.

2. The display tray assembly of claim 1:

wherein the product support area is defined by the center tray section, a portion of the side tray section extending out from the gap, and a portion of the union tray section extending out from the gap.

3. The display tray assembly of claim 1, further comprising;

a plurality of ridges extending in a front-to-back direction along the side tray section and the union tray section;

wherein the center tray section comprises a plurality of clips with downward extending lips, wherein each of the plurality of clips engages the ridges of one of the side tray section and union tray section.

4. The display tray assembly of claim 3, further comprising:

at least one groove transverse and through the ridges of the side tray section; and at least one groove transverse and through the ridges of the union tray section;

wherein the center tray section comprises a plurality of downward extending guides that slide within the at least one groove of the side tray section and at least one groove of the union tray section to facilitate uniform front-to-back movement of the side tray section and union tray section relative to the center tray section.

5. The display tray assembly of claim 1, further comprising a pusher, a spring coil and a fence configured in the center tray section in order to effectuate movement of a product to a front end of the center tray section.

6. The display tray assembly of claim 1, wherein the display tray assembly is configured as a freezer tray assembly.

7. A display tray assembly comprising:

a first base extending in a horizontal dimension;

a first center tray section extending in the horizontal dimension fixedly secured to the first base at a position above the first base to form a first gap therebetween;

a second base extending in the horizontal dimension;

a second center tray section extending in the horizontal dimension secured to the second base at a position above the second base to form a second gap therebetween;

a union tray section extending in the horizontal dimension, the union tray section comprising a first portion moveably positioned within the first gap and a second portion moveably positioned within the second gap;

a vertically extending center wall secured to the union tray section along a center line of the union tray section, the center wall dividing the union tray section into the first portion and the second portion, wherein the first portion of the union tray section and the first center tray section at least partially define a first product support area and the second portion of the union tray section and the second center tray section at least partially define a second product support area;

wherein the union tray section is movable with respect to the first center tray section so as to adjust the width of the first product support area independently of a width of the second product support area.

8. The display tray assembly of claim 7, further comprising:

a plurality of ridges extending in a front-to-back direction along the first portion and the second portion of the union tray section;

wherein the first center tray section comprises at least one first clip with a downward extending first clip and the second center tray section comprises at least one second clip with a downward extending second lip, and the at least one first clip engages the ridges of the first portion of the union tray section and the at least one second clip engages the ridges of the second portion of the union tray section.

9. The display tray assembly of claim 8, further comprising:

at least a first groove transverse and through the ridges of the first portion of the union tray section;

at least a second groove transverse and through the ridges of the second portion of the union tray section;

at least one first guide extending downwardly from the first center tray section, the at least one first guide slides within the at least one first groove of the first portion of the union tray section; and at least one second guide extending downwardly from the second center tray section, the at least one second guide slides within the at least one second groove of the second portion of the union tray section;

wherein the first and second grooves and the first and second guides facilitate uniform front-to-movement of the union tray section relative to the first center tray section and the second center tray section.

10. The display tray assembly of claim 8, further comprising:

at least one first notch through the first portion of the union tray section;

at least one second notch through the second portion of the union tray section;

at least one first lug extending upwardly from the first base, the at least one first lug receives a first fastener extending downwardly from the first center tray section to fixedly secure the first center tray section to the first base; and at least one second lug extending upwardly from the second base, the at least one second lug receives a second fastener extending downwardly from the second center tray section to fixedly secure the second center tray section to the second base;

wherein the at least one first lug is received within at least one first notch and the at least one second lug is received within the at least one second notch to facilitate uniform front-to-back movement of the union tray section relative to the first center tray section and the second center tray section.

11. The display tray assembly of claim 7, wherein the display tray assembly is configured as a freezer tray assembly.

12. The display tray assembly of claim 7, further comprising a pusher, a spring coil and a fence configured in the center tray section in order to effectuate movement of a product to a front end of the center tray section.

13. The display tray assembly of claim 10, further comprising:

at least one third notch through the first portion of the union tray section;

at least one fourth notch through the second portion of the union tray section;

at least one third lug extending upwardly from the first base, the at least one third lug receives a third fastener extending downwardly from the first center tray section to fixedly secure the first center tray section to the first base; and at least one fourth lug extending upwardly from the second base, the at least one fourth lug receives a fourth fastener extending downwardly from the second center tray section to fixedly secure the second center tray section to the second base;

wherein the at least one third lug is received within at least one third notch and the at least one fourth lug is received within the at least one fourth notch to facilitate uniform front-to-back movement of the union tin section relative to the first center tray section and the second ϵ center tray section.

* * * * *